US005226534A

United States Patent [19]

Kim

[11] Patent Number: 5,226,534

[45] Date of Patent: Jul. 13, 1993

[54] PACKAGE FOR SAFETY RAZORS

[75] Inventor: Jisu Kim, Yonkers, N.Y.

[73] Assignee: Tritec International Corporation, New York, N.Y.

[21] Appl. No.: 868,317

[22] Filed: Apr. 14, 1992

[51] Int. Cl.[5] ..... A45C 11/26

[52] U.S. Cl. ..... 206/354; 53/443; 206/45.14; 206/349; 206/476; 206/485

[58] Field of Search ..... 206/352-355, 206/45.14, 372, 376, 476, 485, 488, 489, 349; 53/443

[56] References Cited

U.S. PATENT DOCUMENTS

| | | |
|---|---|---|
| D. 272,803 | 2/1984 | Richards . |
| D. 276,793 | 12/1984 | Richards . |
| D. 276,893 | 12/1984 | Richards . |
| D. 282,242 | 1/1986 | Thorpe . |
| 942,483 | 12/1909 | Clark . |
| 1,192,859 | 8/1916 | Canfield . |
| 1,194,372 | 8/1916 | Fischer . |
| 1,860,324 | 5/1932 | Einson . |
| 1,956,642 | 5/1934 | Einson . |
| 2,229,427 | 1/1941 | Tanner . |
| 2,911,096 | 11/1959 | Andre . |
| 2,968,392 | 1/1961 | Schwebs . |
| 3,207,303 | 9/1965 | Breedveld . |
| 3,587,837 | 6/1971 | Smith . |
| 3,735,860 | 5/1973 | Nissen et al. . |
| 3,797,729 | 3/1974 | Holmes . |
| 3,884,350 | 5/1975 | Johansson . |
| 3,978,980 | 9/1976 | Roccaforte . |
| 4,062,450 | 12/1977 | Carter . |
| 4,140,244 | 2/1979 | Clabby . |
| 4,153,162 | 5/1979 | Samsing . |
| 4,201,294 | 5/1980 | Roccaforte . |
| 4,266,664 | 5/1981 | Dixon et al. . |
| 4,319,680 | 3/1982 | Hiemstra . |
| 4,322,002 | 3/1982 | Iten . |
| 4,341,306 | 7/1982 | Lightsey . |
| 4,432,452 | 2/1984 | Kelly . |
| 4,445,610 | 5/1984 | Richards . |
| 4,496,047 | 1/1985 | Gatley . |
| 4,721,208 | 1/1988 | Thorpe . |

FOREIGN PATENT DOCUMENTS

| | | | |
|---|---|---|---|
| 1185560 | 8/1959 | France | 206/485 |
| 16110 | 6/1965 | Japan . | |
| 31952 | 11/1965 | Japan . | |
| 80794 | 10/1973 | Japan . | |
| 71189 | 6/1975 | Japan . | |
| 25997 | 6/1977 | Japan . | |
| 1028610 | 5/1966 | United Kingdom . | |
| 1029268 | 5/1966 | United Kingdom . | |
| 1241438 | 8/1971 | United Kingdom . | |
| 1327840 | 8/1973 | United Kingdom . | |
| 2003820 | 3/1979 | United Kingdom . | |

*Primary Examiner*—Bryon P. Gehman

*Attorney, Agent, or Firm*—Rocco S. Barrese; Peter G. Dilworth; Joseph J. Catanzaro

[57] ABSTRACT

A package for displaying a plurality of safety razors is provided which includes opposed front and rear panels articulated to one another to define an enclosure. Each of the opposed front and rear panels has an elongated slot provided therein defining a blade head maintaining area for the razors. An upper panel extends from the front panel to the rear panel above the blade head maintaining area. Structure projects into at least one of the opposed slots for inhibiting movement of the plurality of razors within the blade head maintaining area. In addition, a passageway descends from at least one of the slots in the opposed panels for permitting individual removal of the plurality of razors from the package while inhibiting the egress of the remaining razors therethrough.

37 Claims, 6 Drawing Sheets

PACKAGE FOR SAFETY RAZORS

BACKGROUND OF THE INVENTION

1. Field of the Invention

This invention relates to a package for displaying merchandise, and more particularly to a package for displaying a plurality of safety razors.

2. Description of the Related Art

A safety razor is of the type which comprises an elongated handle portion and a transverse shaving blade unit which extends from an end of the handle portion. A plurality of such razors are commonly displayed and merchandised in a single package or enclosure. In some instances, the display package is of the type which can be placed on a display rack and contain razors which are readily removed by the end user. In other instances, the razors are simply packaged in a closed plastic wrap.

Display packages for safety razors include those described in, for example: U.S. Pat. No. 4,266,664 to Dixon et al.; U.S. Pat. No. 4,341,306 to Lightsey; and U.S. Pat. No. 4,445,610 to Richards. Although these display packages are often adequate to display a plurality of nested razors, once one of the razors has been removed by a user, the package may cease to become an effective storage structure for the remaining razors. More particularly, upon removing the first nested razor, the remaining razors may easily dislodge from the enclosure and become displaced.

It is desirable therefore, to provide a package for displaying and merchandising a plurality of safety razors, having structure which prohibits the displacement of the razors therefrom once one or more of the razors has been removed from the package.

SUMMARY OF THE INVENTION

The display package of the subject invention essentially comprises an enclosure for displaying a plurality of safety razors in side-by-side nested relationship. Each of the safety razors has an elongated handle and a transverse blade head which is connected to the handle.

The package includes opposed front and rear panels which are connected to one another to define a housing for at least a portion of the handles of the plurality of razors. Each of the opposed panels has an elongated slot provided therein, with the opposed slots being substantially aligned with one another and defining a blade head maintaining area for the plurality of razors. A roof panel connects the front panel and the rear panels above the blade head maintaining area. Preferably, the roof panel is formed integral with the opposed front and rear panels of the package. However, the roof panel may be a separate member which can be affixed to a pair of spaced apart upper wall portion formed integral with the opposed front and rear panels of the package.

The display package further includes inhibiting means which are associated with at least one of the opposed elongated slots. The inhibiting means is positioned between the end portions of at least one of the elongated slots for limiting movement of the plurality of razors within the blade head maintaining area. Preferably, the inhibiting means includes a ramped structure which project into at least one of the slots in the opposed panels. The ramped structure is configured as a scalene triangle having a leading edge and a trailing edge, with the angle between the leading edge and the trailing edge being approximately equal to 95°. The angle between the leading edge and the vertex is about 65°, and the angle between the trailing edge and the vertex is about 35°. The package can be provided with a pair of these structures including a first ramped inhibiting structure projecting into the elongated slot formed in the front panel, and a second ramped inhibiting structure, in substantial alignment with the first, projecting into the elongated slot formed in the rear panel.

The display package further includes circuitous passage means in communication with the elongated slot in one of the opposed panels for permitting the individual removal of the plurality of razors from the package while at the same time prohibiting the egress of the remaining razors therethrough. Preferably, the circuitous passage means is defined by a serpentine path having an entrance and an exit, with the entrance being in communication with the slot formed in one of the opposed panels and the exit being disposed adjacent a bottom edge of the panel.

The subject invention is further directed to a method for packaging and displaying a plurality of safety razors in side-by-side nested relationship. The method first comprises the step of providing a package which includes opposed first and second panels connected to each other to define a blade head maintaining area, a panel extending from the first panel to the second panel above the blade head maintaining area, and inhibiting means projecting into the blade head maintaining area for limiting movement of the plurality of razors within the blade head maintaining area. The second step comprises positioning the plurality of safety razors in side-by-side nested relationship in such a manner so that the transverse blade heads are positioned in the blade head maintaining area and extend to each side of the first and second panels, at least portions of the razor handles being positioned between the first and second panels, and at least one of the transverse blade heads being positioned on one side of the razor movement inhibiting means and the remaining blade heads positioned on the other side thereof.

Further features of the invention will become more apparent from the accompanying drawings and the following detailed description of the invention.

BRIEF DESCRIPTION OF THE DRAWINGS

Preferred embodiments of the invention will be described hereinbelow with reference to the drawings wherein.

DETAILED DESCRIPTION OF THE PREFERRED EMBODIMENTS

Figure 1:
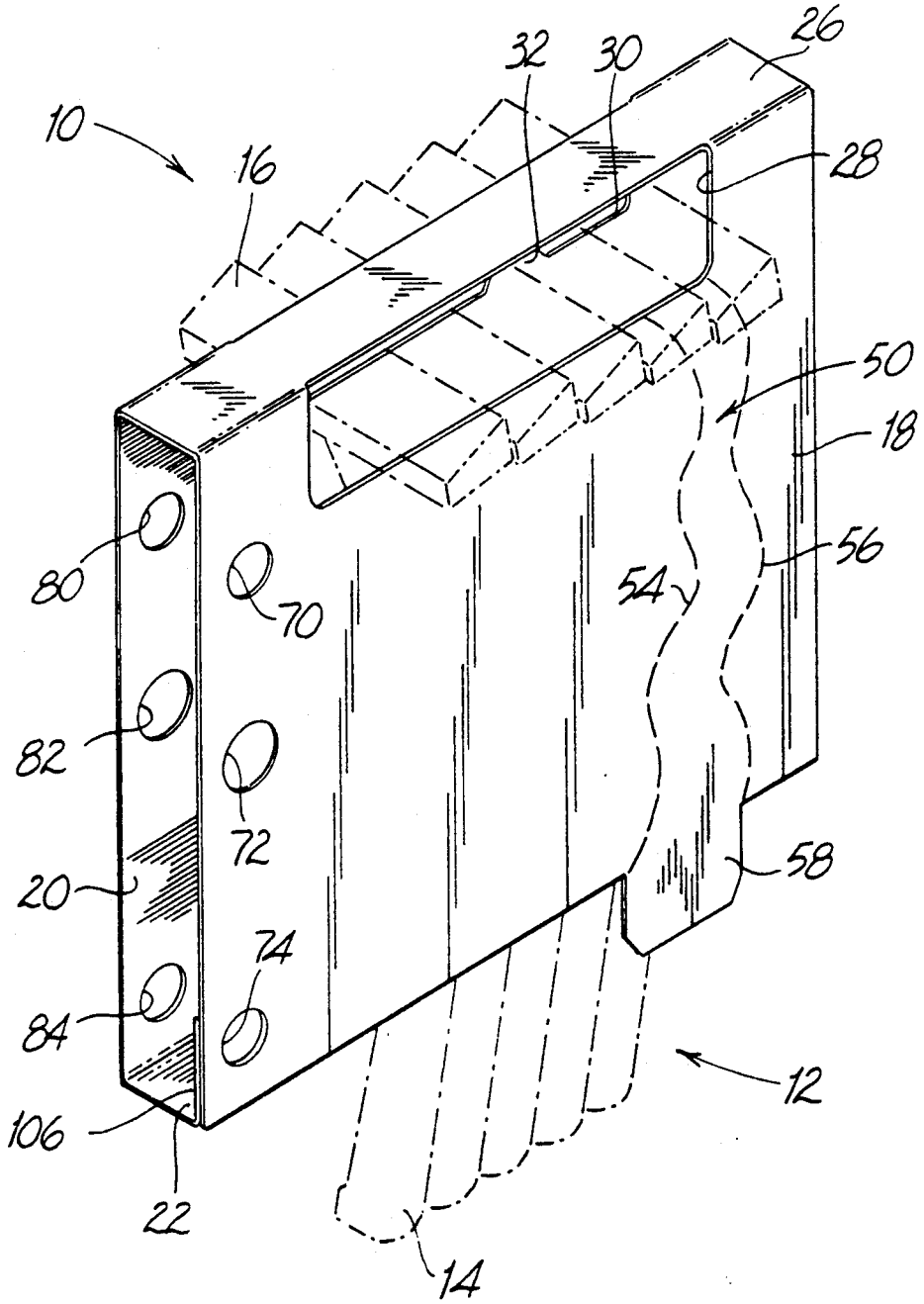
FIG. 1 is a perspective view of a display package for safety razors constructed in accordance with a preferred embodiment of the subject invention.

Referring now in detail to the drawings in which like reference numerals indicate similar or identical elements, a preferred embodiment of the package for displaying safety razors is illustrated in FIG. 1 and is designated generally by reference numeral 10. Display package 10 is provided for housing a plurality of safety razors 12 each having an elongated handle portion 14 and a transverse blade head 16 depending from the handle portion 14. More particularly, the display package 10 is provided as an enclosure for maintaining a plurality of razors 12 in side-by-side nested relationship.

Figure 2:
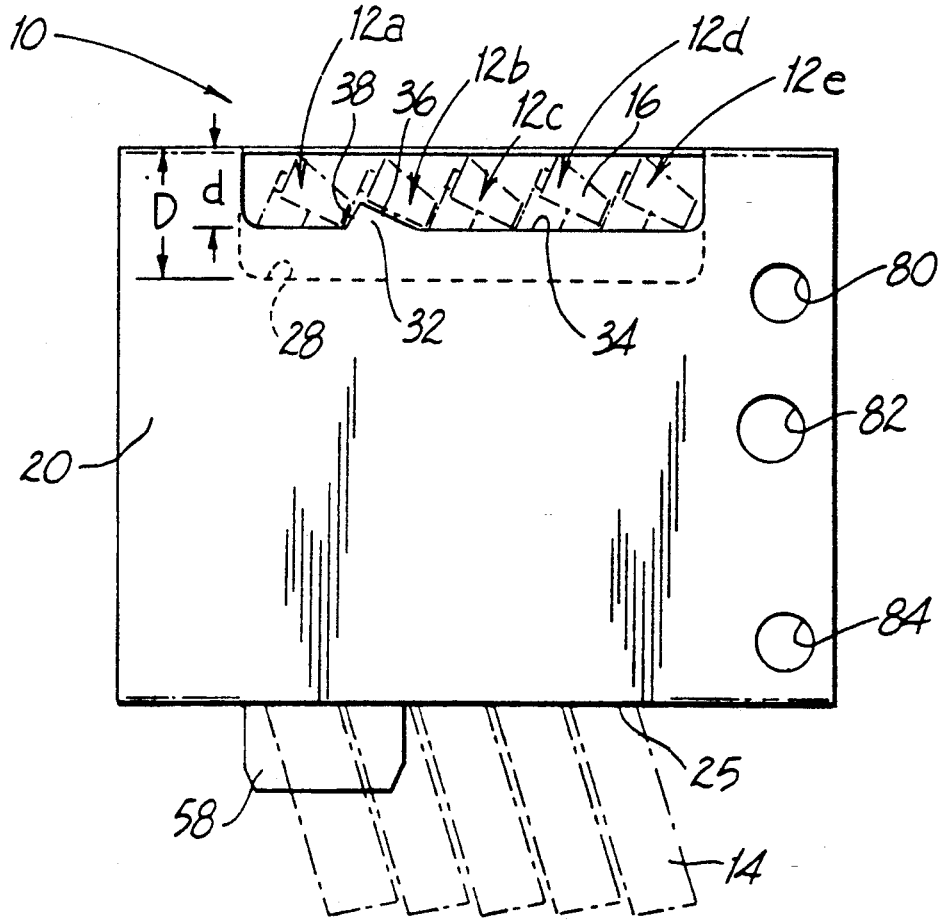
FIG. 2 is a side elevational view of the display package of FIG. 1.
Figure 3:
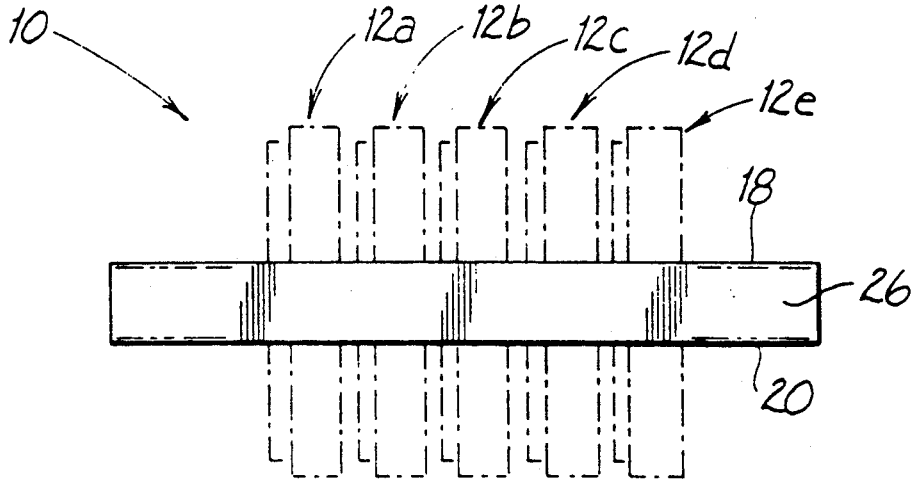
FIG. 3 is a top plan view of the display package of FIG. 1.
Figure 4:
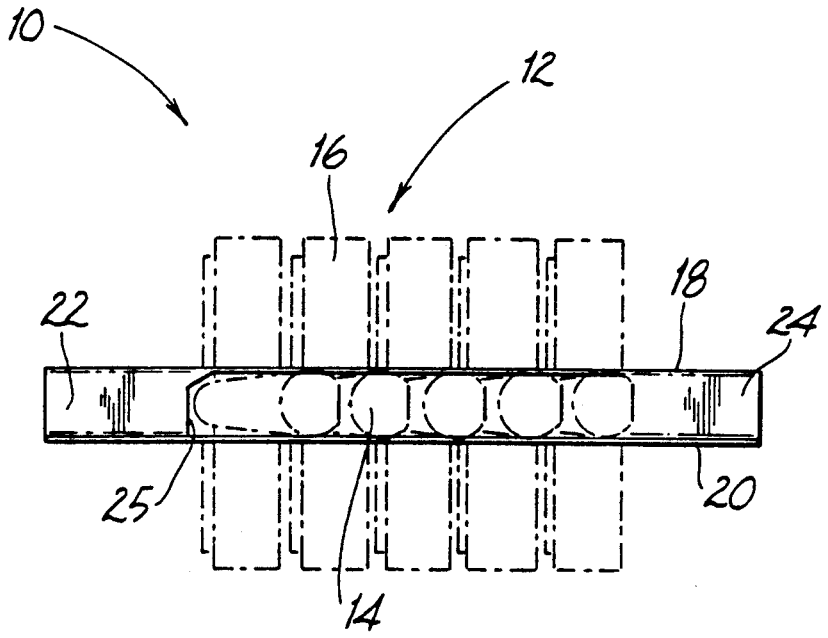
FIG. 4 is a bottom plan view of the display package of FIG. 1.

Referring to FIGS. 2–4, the display package 10 comprises opposed front and rear panels 18 and 20 which are articulated to one another. Specifically, the front and rear panels 18 and 20 are connected at the bottom edges thereof by a pair of spaced apart bottom wall portions 22 and 24 which define an opening 25 therebetween through which the handle portions 14 of each of the plurality of razors 12 may extend. These wall portions assist in containing the handle portions 14 of the razors 12 on either side thereof and in the predetermined portions shown. The opposed front and rear panels 18 and 20 are interconnected at the top edges thereof by an integral roof panel 26 which extends from the front panel 18 to the rear panel 20.

The rear panel 20 of display package 10 is provided with an elongated slot 30. A corresponding elongated slot 28 is provided in the front panel 18 of display package 10. The slot 30 in rear panel 20 has a depth "d" which is less than the depth "D" of the elongated slot 28 formed in the front panel 18 of package 10. The opposed slots 28 and 30 define an area within which the blade heads 16 of the plurality of razors 12 may be maintained in a closely nested manner. In particular, the elongated slot 30 in rear panel 20 provides structural support for maintaining the transverse blade heads 16 in this condition. Additionally, the relative difference of the depth of the slots 28 and 30 permits twisting or maneuvering of each razor and thereby assists in the removal of the razors 12 from the blade head maintaining area of package 10.

The display package 10 also incorporates structure for inhibiting the movement of a plurality of razors 12 within the blade head maintaining area described hereinabove. More particularly, referring to FIG. 2, the razor movement inhibiting structure is provided for preventing the second through fifth razors, **12*b* through 12*e*, from sliding forward upon removal of the first-in-line razor 12*a* from the package 10. The movement inhibiting structure includes a ramped projection 32 which ascends into the elongated slot 30 from the lower edge 34 thereof, and has the configuration of a scalene triangle. The ramped projection 32 has a leading edge 36 disposed at about 65° relative to the vertex of the triangle, and a trailing edge 38** disposed at about 30° relative to the vertex of the triangle.

The angle of the leading edge 36 of ramped projection 32 is complementary to the angle at which the blade head 16 of razor **12*b* is disposed relative to the handle portion 14 thereof. While this cooperation between the blade head 16 and the ramped projection 32 functions to inhibit the movement of the second through fifth razors, 12*b* through 12*e*, upon removal of the first-in-line razor 12*a* from the package 10**, it further functions to maintain the remaining razors in desired closely nested relationship at all times. This configuration best matches the shape of the razors shown. However, they may be altered in dependence upon the particular razors which are packaged.

The display package 10 also incorporates structure for enabling the individual removal of the plurality of razors 12 from the package 10, while at the same time prohibiting the egress of the remaining razors therethrough. This blade removal structure includes a serpentine passageway 50 defined in the front panel 18 proximate to the ramped projection 32 formed in the blade head maintaining area of the display package 10. The serpentine passageway 50 is defined by spaced apart serpentine perforation lines 54 and 56, and is initially sealed prior to purchase of the display package 10 by the end user. A pull tab portion 58 depends from the bottom of the package 10, between perforation lines 54 and 56, for easing the removal of the material defined thereby. When the pull tab portion 58 is removed, removal of each razor is intentionally inhibited by the provision of a circuitous path defined by the perforation lines 54 and 56. This feature will also prevent unwanted or inadvertent removal of the razors from the package.

As will be appreciated, the serpentine passageway 50 includes widthwise dimensions which vary over the height of package 10, and which are appropriate to inhibit movement of a razor therethrough. For example, the widthwise dimension at the lower end of the serpentine passageway 50 is relatively wide as compared to the corresponding dimension of the adjacent razor portion, whereas the widthwise dimension of the serpentine passageway at the upper end may be relatively narrow or about equal to the corresponding dimension of the adjacent razor portion.

The display package 10 is provided with a plurality of apertures formed in registry with one another in the opposed front and rear panels 18 and 20 for hanging the package 10 on a display rack. In particular, first, second, and third apertures, 70, 72, and 74 are provided in front panel 18, while corresponding first, second, and third apertures, 80, 82, and 84 are provided in the rear panel 20 of the package 10. The corresponding second apertures 72 and 82 may be utilized for hanging the package 10 in a straight position, while either the first set of apertures 70 and 80, or the third set of apertures 74 and 84, may be utilized in order to hang the package 10 in an angularly disposed manner. The aperture selected will depend upon the space available in the package display rack.

Figure 5:
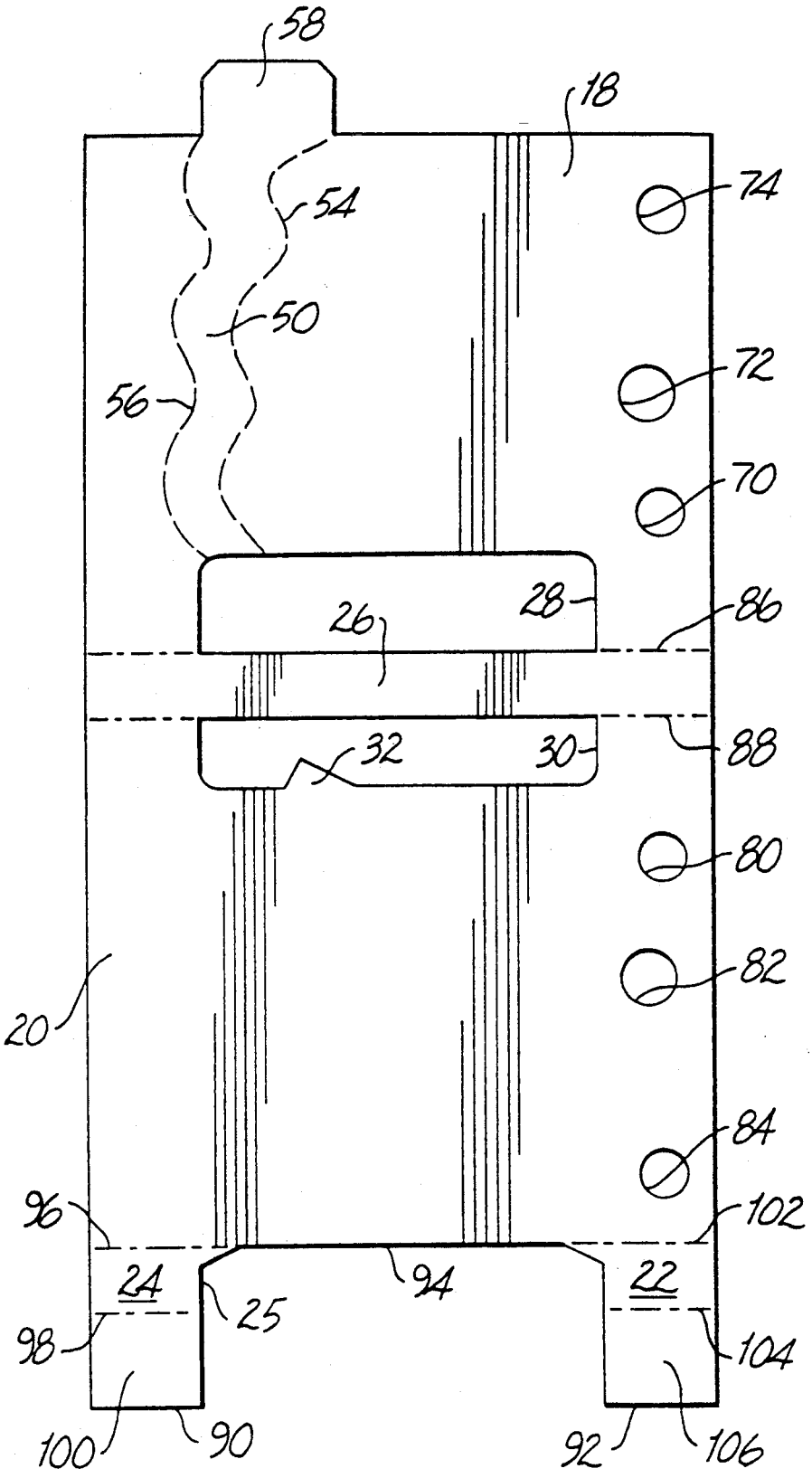
FIG. 5 is a top plan view of a planar blank utilized for constructing the display package of FIG. 1.

Referring to FIG. 5, a blank for constructing the display package 10 of the subject invention is illustrated which essentially comprises a planar card having a plurality of score lines along which the blank may be folded to form the package. First and second parallel score lines 86 and 88 are disposed intermediate the front and rear panels 18 and 20 and define the integral roof panel 26 therebetween. Opposed flaps 90 and 92 extend foldably from the lower edge 94 of the rear panel 20 defining the opening 25 therebetween which permits the handles of the razors to extend from the constructed package. Primary and secondary parallel score lines 96 and 98 are provided on flap 90, defining bottom wall portion 24 therebetween and in addition, defining a tab 100 for mounting adjacent the front panel 18. Similarly, flap 92 is provided with primary and secondary score lines 102 and 104 which define both the bottom wall portion 22 of package 10 and another tab 106 for mounting adjacent the front panel 18. The planar blank shown in FIG. 5 may be of packaging cardboard or another suitable material.

Figure 6:
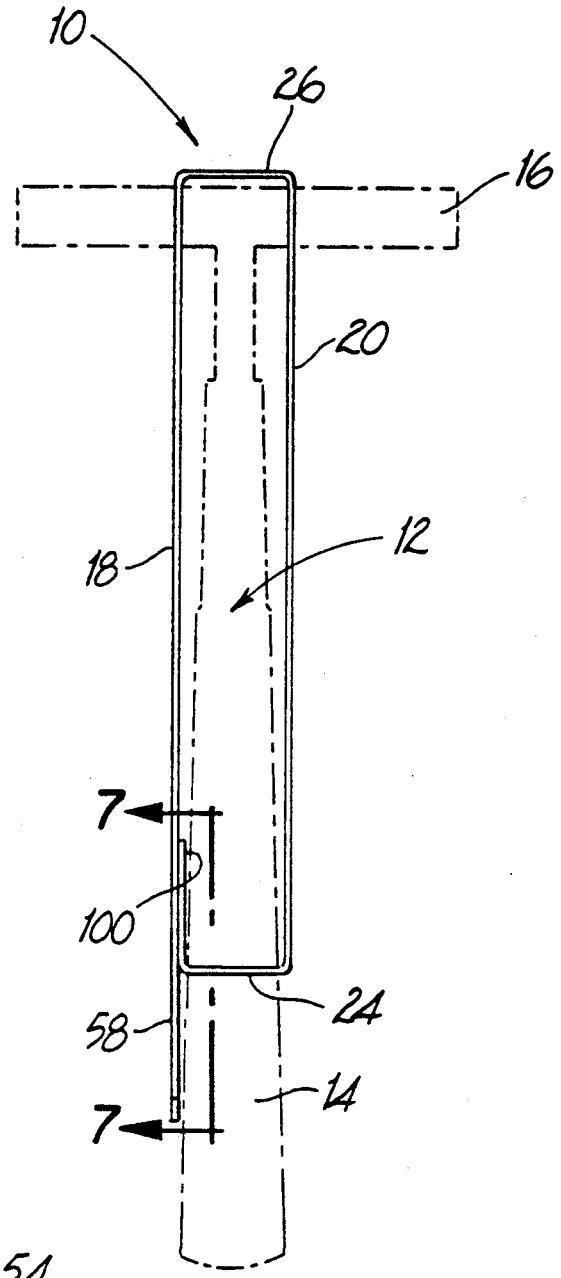
FIG. 6 is an end elevational view of the display package of FIG. 1.
Figure 7:
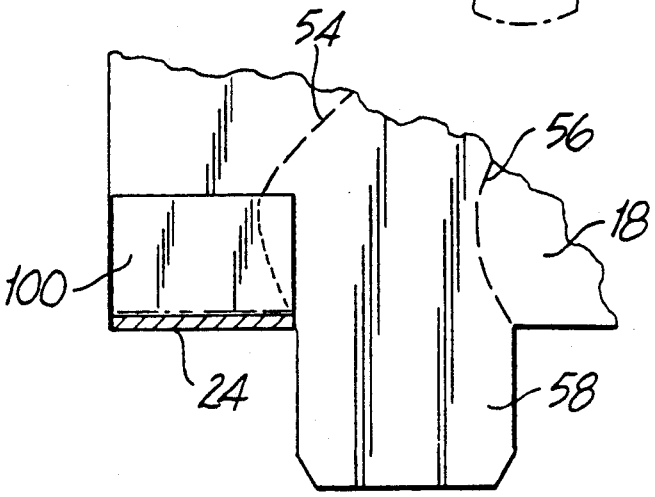
FIG. 7 is an enlarged view taken along line 7—7 in FIG. 6 illustrating the lower portion of a removable pull tab.

To construct the display package 10 from the planar blank of FIG. 5, the opposed front and rear panels 18 and 20 are first brought into parallel alignment with each other by folding the front panel 18 along score line 86 while folding rear panel 20 along score line 88. Thereafter, flaps 90 and 92 are folded along primary score lines 96 and 102 respectively, and subsequently, along respective secondary score lines 98 and 104. Finally, the spaced apart mounting tabs 100 and 106 are affixed to the inner surface of the front panel 18, as best seen in FIGS. 6 and 7. The method of affixation can include, among techniques, gluing, sonic welding or stapling.

Figure 8:
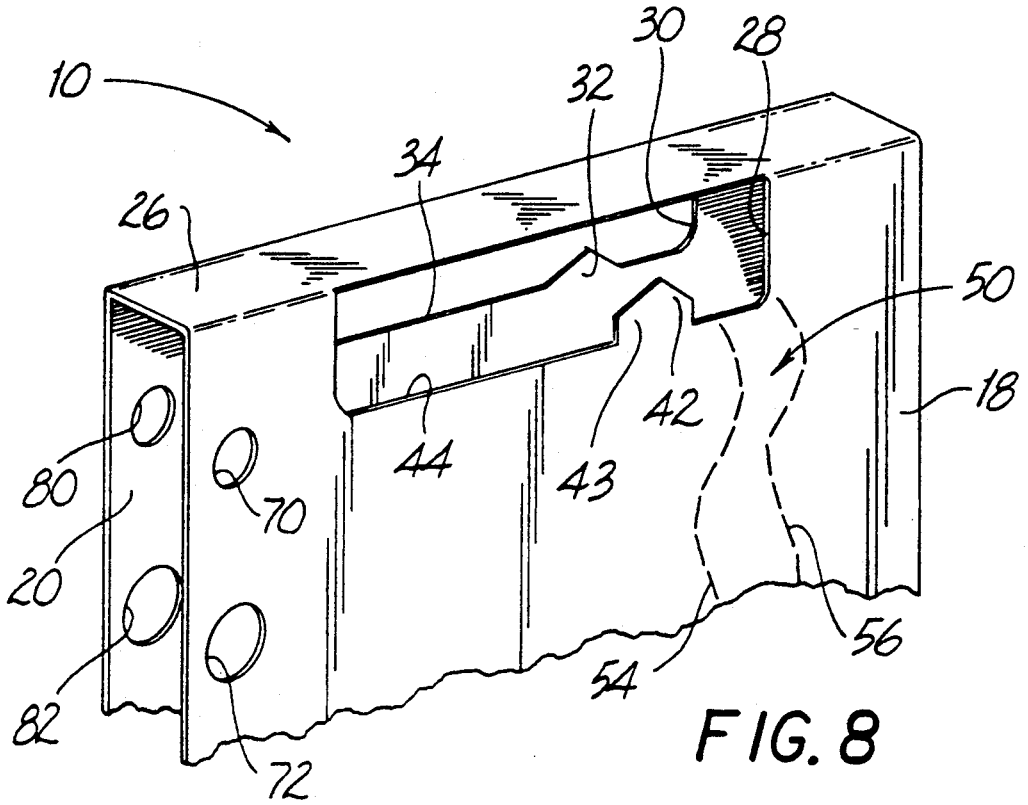
FIG. 8 is a perspective view of the upper portion of the display package of FIG. 1 illustrating an alternative embodiment of the razor inhibiting structure.

Referring to FIG. 8, an alternative embodiment of the invention is described wherein package 10 is provided with a pair of ramped projections in registration with each other and arranged for inhibiting the movement of a razors 12 within the blade head maintaining area thereof. The registered projections include the first ramped projection 32 which ascends into the elongated slot 30 as described hereinabove, and a second ramped projection 42, geometrically similar to the first ramped projection 32, which ascends into the elongated slot 28 on an upstanding perch 43 extending from the bottom edge 44 thereof. The pair of registered ramped projections 32 and 42 cooperate with one another in such a manner so as to prohibit movement of the plurality of razors 12 within the blade head maintaining area of the display package 10. However, the relative difference in the depth of the slots assists the user in removing the razors individually as needed, as described in the previous embodiment.

Figure 9:
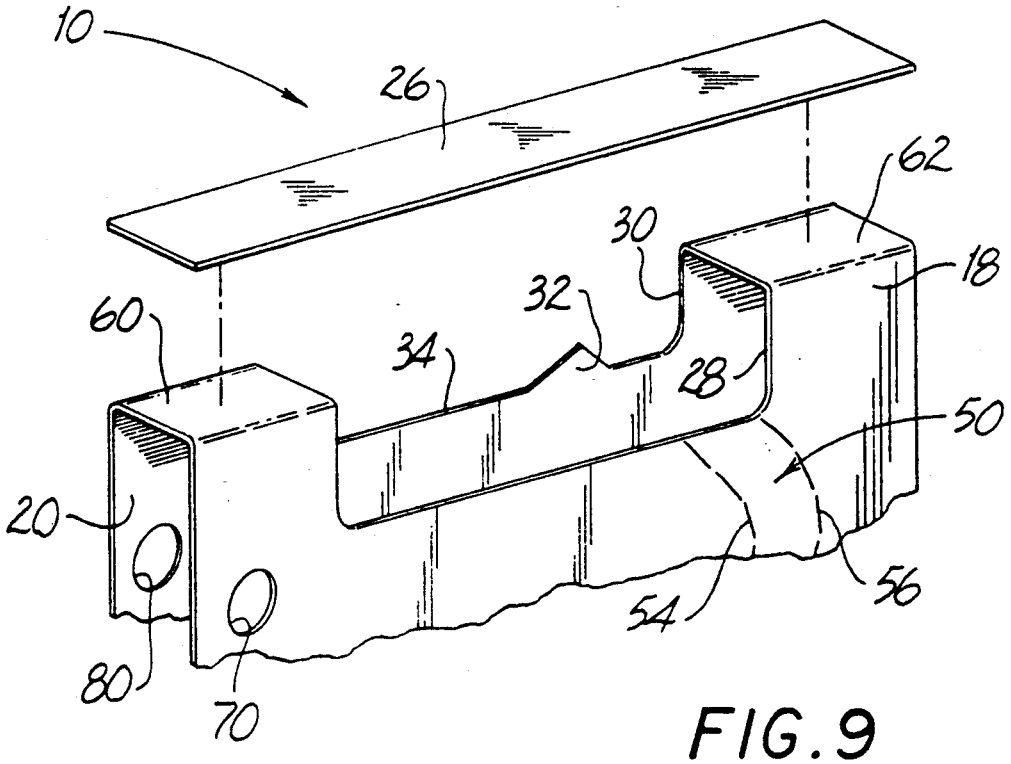
FIG. 9 is a perspective view of another alternative embodiment of the display package incorporating a two-part structure.

Turning now to FIG. 9, an alternative embodiment of the display package is illustrated and includes a unitary roof panel 26. In this embodiment, the front panel 18 is articulated to the opposed rear panel 20 by a pair of spaced apart upper wall portions 60 and 62. To assemble the display package 10, the unitary roof panel 26 is affixed to the opposed upper wall portions 60 and 62 in such a manner so as to extend from the front panel 18 to the rear panel 20 to substantially cover the blade head maintaining area defined therein. Attachment of roof panel 26 above the upper wall portions 60 and 62 may be accomplished by gluing, stapling or other appropriate techniques.

As can be seen from the description of the unique package for safety razors, a method of packaging and displaying such razors is disclosed, whereby the razors are maintained in side-by-side nested relationship within the blade head maintaining area by positioning at least one of the razors on one side of the ramped projection while positioning the remaining razors on the opposed side thereof.

Although the subject invention has been shown and described with respect to a preferred embodiment, it will be understood by those skilled in the art that various modifications and changes may be made therein without departing from the spirit and scope of the invention.

What is claimed is:

1. A package for displaying a plurality of safety razors in side-by-side nested relationship, wherein the safety razors to be displayed each have an elongated handle and a transverse blade head connected thereto, which comprises:

a) opposed first and second panels connected to each other to define an enclosure for housing at least a portion of the handles of such razors, each of said opposed first and second panels having an elongated slot formed therein and generally opposed with the other and together defining a blade head maintaining area for a plurality of such razors;

b) a panel connecting said first and second panels at upper end portions thereof; and c) a projection extending into at least one of said elongated slots between end portions thereof for limiting movement of such razors within said blade head maintaining area.

2. A package for displaying a plurality of safety razors in side-by-side nested relationship, wherein the safety razors to be displayed each have an elongated handle and a transverse blade head connected thereto, which comprises:

a) a first panel and a second panel articulated to each other to define an enclosure for housing at least a portion of the handles of such razors, each of said first and second panels having an elongated slot formed therein and generally opposed to each other and defining a blade head maintaining area for a plurality of such razors;

b) a roof panel connecting said first panel to said second panel at upper end portions thereof; and c) inhibiting means projecting into at least one of said elongated slots for limiting movement of such razors within said blade head maintaining area.

3. A package as recited in claim 2, further comprising circuitous passage means descending from at least one of said elongated slots in said first and second panels for permitting individual removal of such razors from said package.

4. A package as recited in claim 3, wherein said circuitous passage means is a serpentine path having an entrance and an exit, said entrance communicating with at least one of said elongated slots and said exit disposed adjacent a bottom edge of at least one of said first and second panels.

5. A package as recited in claim 4, wherein said inhibiting means is disposed proximate said circuitous passage means.

6. A package as recited in claim 2, wherein said inhibiting means comprises a ramped structure ascending into at least one of said elongated slots in one of.

7. A package as recited in claim 6, wherein said ramped structure is configured as a scalene triangle having a leading edge and a trailing edge, said leading edge disposed at about 65° relative to the vertex of said triangle and said trailing edge disposed at about 30° relative to the vertex of said triangle.

8. A package as recited in claim 2, wherein said inhibiting means comprises a first ramped structure which ascends into said elongated slot in said first panel and a second ramped structure which ascends into said elongated slot in said second panel in registration with said first ramped structure.

9. A package as recited in claim 2, wherein said elongated slot formed in said first panel has a predetermined depth which is distinct from a predetermined depth of said elongated slot formed in said second panel.

10. A package as recited in claim 9, wherein said elongated slot in said second panel is of a depth less than the depth of said elongated slot in said first panel and defines a support slot for supporting the transverse blade heads of such razors.

11. A package as recited in claim 2, wherein said roof panel is integral with said opposed first and second panels.

12. A package as recited in claim 11, wherein said roof panel is monolithically formed with said opposed first and second panels.

13. A package as recited in claim 11, wherein said roof panel is a unitary member affixed to said package.

14. A package as recited in claim 2, wherein said opposed first and second panels are articulated to one another at the upper edges thereof by spaced apart upper wall portions.

15. A package as recited in claim 2, wherein said opposed first and second panels are articulated to each other at the lower edges thereof by spaced apart lower wall portions which define an opening therebetween for reception of the lower end portions of such razor handles.

16. A package for displaying a plurality of safety razors in side-by-side nested relationship, wherein the safety razors to be displayed each have an elongated handle and a transverse blade head connected to said handle, which comprises:

a) a first panel and a second panel articulated to each other to define an enclosure for housing at least a portion of the handles of such razors, each of said panels having an elongated slot formed therein substantially aligned with each other and defining a blade head maintaining area for such razors;

b) a roof panel extending from said first panel to said second panel above said blade head maintaining area;

c) inhibiting means projecting into at least one of said aligned elongated slots for limiting movement of such razors within said blade head maintaining area; and d) circuitous passage means communicating with at least one of said slots in said first and second panels for permitting individual removal of such razors from said package while inhibiting egress of such remaining razors therethrough.

17. A package as recited in claim 16, wherein said roof panel is integral with said first and second panels of said package.

18. A package as recited in claim 17, wherein said roof panel is a unitary member which is affixed to said package.

19. A package as recited in claim 17, wherein said roof panel is monolithically formed with said first and second panels.

20. A package as recited in claim 16, wherein said first and second panels are articulated to each other at the upper portion thereof by spaced apart upper wall portions.

21. A package as recited in claim 16, wherein said first and second panels are articulated to each other at the lower edges thereof by spaced apart lower wall portions which define an opening therebetween for the reception of the lower end portions of such razor handles.

22. A package as recited in claim 16, wherein said inhibiting means comprises at least one ramped structure disposed proximate said circuitous passage means.

23. A package as recited in claim 22, wherein said ramped structure is configured as a scalene triangle having a leading edge and a trailing edge, said leading edge disposed at about 65° relative to the vertex of said triangle and said trailing edge disposed at about 30° relative to the vertex of said triangle.

24. A package as recited in claim 16, wherein said inhibiting means comprises a first ramped structure ascending into said elongated slot formed in said first panel and a second ramped structure ascending into said elongated slot formed in said second panel in registration with said first ramped structure.

25. A package as recited in claim 16, wherein said circuitous passage means is a serpentine path having an entrance and an exit, entrance communicating with said at least one of said elongated slots and said exit is disposed adjacent a bottom edge of at least one of said first and second panel.

26. A package as recited in claim 16, wherein said first panel defines a front panel and said second panel defines a rear panel.

27. A package as recited in claim 26, wherein said elongated slot formed in said front panel has a predetermined depth which is distinct from a predetermined depth of said elongated slot formed in said rear panel.

28. A package as recited in claim 27, wherein said elongated slot formed in said rear panel is of a depth less than the depth of said elongated slot in said front panel and defines a support slot for supporting the transverse blade heads of such razors.

29. A package for containing and displaying a plurality of safety razors in side-by-side nested relationship, wherein the safety razors to be displayed each have an elongated handle and a transverse blade head connected thereto, which comprises:

a) a first panel and second panel connected to each other to define an enclosure for housing at least a portion of the handles of such razors, each of said first and second panels having an elongated slot formed therein substantially aligned with each other and defining a blade head maintaining area for such plurality of razors;

b) a panel connecting said first panel to said second panel at upper end portions thereof; and c) inhibiting means projecting into at least one of said elongated slots at a location corresponding to a position between two of such razors for maintaining at least one of such razors on one side of said inhibiting means with such remaining razors in nested relationship on the other side of said inhibiting means.

30. A package as recited in claim 29, wherein said inhibiting means comprises a ramped structure ascending into at least one of said elongated slots.

31. A card for forming a package for safety razors, which comprises:

a) a first panel having a first edge and a second edge and having an elongated slot defined therein adjacent said first edge, and including:

i) a triangular projection extending into said elongated slot from an edge thereof;

b) a second panel foldably connected to said first panel along said first edge thereof;

c) a third panel foldably connected to said second panel and having an elongated slot formed therein adjacent said second panel;

d) a fourth panel foldably depending from a second edge of said first panel;

e) a first mounting tab foldably connected to said fourth panel;

f) a fifth panel foldably depending from said second edge of said first panel spaced from said fourth panel; and g) a second mounting tab foldably connected to said fifth panel.

32. A card as recited in claim 31, wherein said elongated slot formed in said first panel has a predetermined height which is distinct from a predetermined height of the elongated slot formed in said third panel.

33. A card as recited in claim 31, wherein a circuitous passage is defined in said third panel in communication with said elongated slot in said third panel.

34. A card as recited in claim 33, wherein said circuitous passage is defined by perforated lines which permit removal of card material therebetween.

35. A method for packaging and displaying a plurality of safety razors in side-by-side nested relationship, each of said plurality of safety razors having an elongated handle portion with a transverse blade head connected thereto, comprising the steps of:

a) providing a package including:

i) opposed first and second panels connected to each other to define a blade head maintaining area;

ii) a panel extending from said first panel to said second panel above said blade head maintaining area; and iii) inhibiting means projecting into said blade head maintaining area for limiting movement of such razors within said blade head maintaining area; and b) positioning a plurality of safety razors in side-by-side nested relationship with the transverse blade heads positioned in said blade head maintaining area and extending to each side of said first and second panels, and at least portions of said razor handles positioned between said first and second panels, and at least one of said transverse blade heads being positioned on one side of said inhibiting means and the remaining of said blade heads being positioned on the other side thereof.

36. A package containing and displaying a plurality of safety razors in side-by-side nested relationship, wherein the safety razors each have an elongated handle and a transverse blade head connected thereto, which comprises:

a) opposed first and second panels connected to each other to define an enclosure for housing at least a portion of the handles of the razors, each of said opposed first and second panels having an elongated slot formed therein and generally opposed with the other and together defining a blade head maintaining area for the plurality of razors;

b) a panel connecting said first and second panels at upper end portions thereof; and c) a projection extending into at least one of said elongated slots between end portions thereof for limiting movement of the razors within said blade head maintaining area.

37. A package containing and displaying a plurality of safety razors in side-by-side nested relationship, wherein the safety razors each have an elongated handle and a transverse blade head connected thereto, which comprises:

a) a first panel and a second panel articulated to each other to define an enclosure for housing at least a portion of the handles of the razors, each of said first and second panels having an elongated slot formed therein and generally opposed to each other and defining a blade head maintaining area for the plurality of razors;

b) a roof panel connecting said first panel to said second panel at upper end portions thereof; and c) inhibiting means projecting into at least one of said elongated slots for limiting movement of the razors within said blade head maintaining area.

* * * * *